United States Patent [19]

Ash

[11] Patent Number: 4,465,230

[45] Date of Patent: Aug. 14, 1984

[54] METHOD AND APPARATUS FOR MAKING SNOW

[76] Inventor: Robert M. Ash, P.O. Box 364, Banner Elk, N.C. 28604

[21] Appl. No.: 397,554

[22] Filed: Jul. 12, 1982

[51] Int. Cl.[3] ..... F25C 3/04

[52] U.S. Cl. ..... 239/2 S; 239/14; 239/434.5; 239/553.5

[58] Field of Search ..... 239/2 S, 14, 419, 424, 239/434.5, 589, 553, 553.5

[56] References Cited

U.S. PATENT DOCUMENTS

| | | | |
|---|---|---|---|
| 2,865,830 | 12/1958 | Zoldas | 239/533.3 |
| 3,494,559 | 2/1970 | Skinner | 239/2 S |
| 3,744,724 | 7/1973 | Caille | 239/533.5 |
| 4,194,689 | 3/1980 | Ash | 239/2 S |
| 4,275,833 | 6/1981 | Fairbank | 239/2 S |

*Primary Examiner*—Andres Kashnikow

*Attorney, Agent, or Firm*—Woodford R. Thompson, Jr.

[57] ABSTRACT

Method and apparatus for making snow wherein water under pressure is introduced into a water receiving passageway within a closed inner housing. The inner housing is mounted within a closed outer housing to define an air receiving passageway therebetween. Concomitantly with the introduction of water into the inner housing, air under pressure is introduced into the air receiving passageway where it is divided into a plurality of laminar flowing columns of air. The water within the water receiving passageway is discharged through a plurality of water discharge orifices with each orifice adapted to discharge a laminar flowing jet stream of water. A plurality of discharge chambers is provided in the outer housing in alignment with the water discharge orifices in the inner housing. Each water discharge orifice thus directs its laminar flowing jet stream of water through the axial center of the adjacent discharge chamber with a laminar flowing column of air surrounding the jet stream as it passes through the discharge chamber.

7 Claims, 9 Drawing Figures

Fig. 4
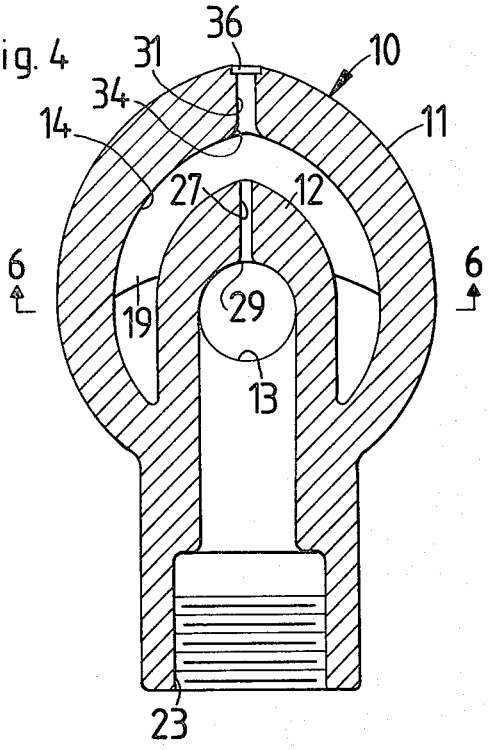
Fig. 5
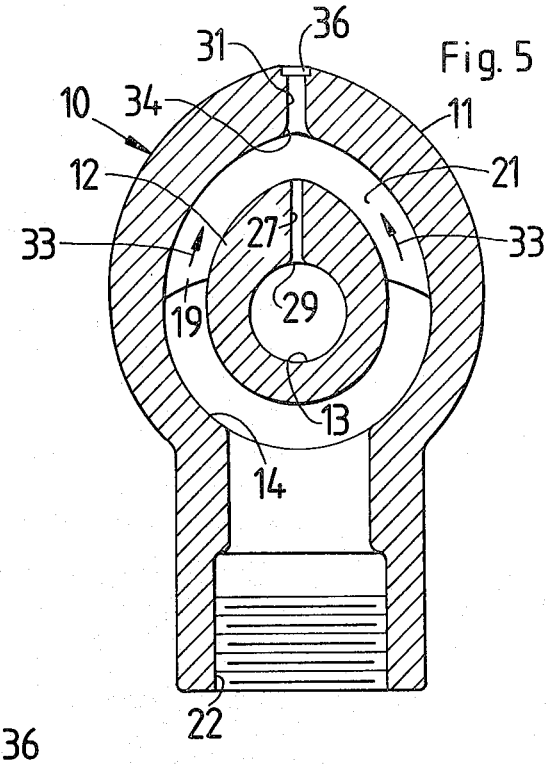
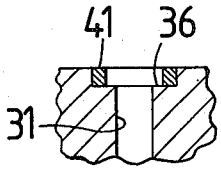
Fig. 7a
Fig. 2
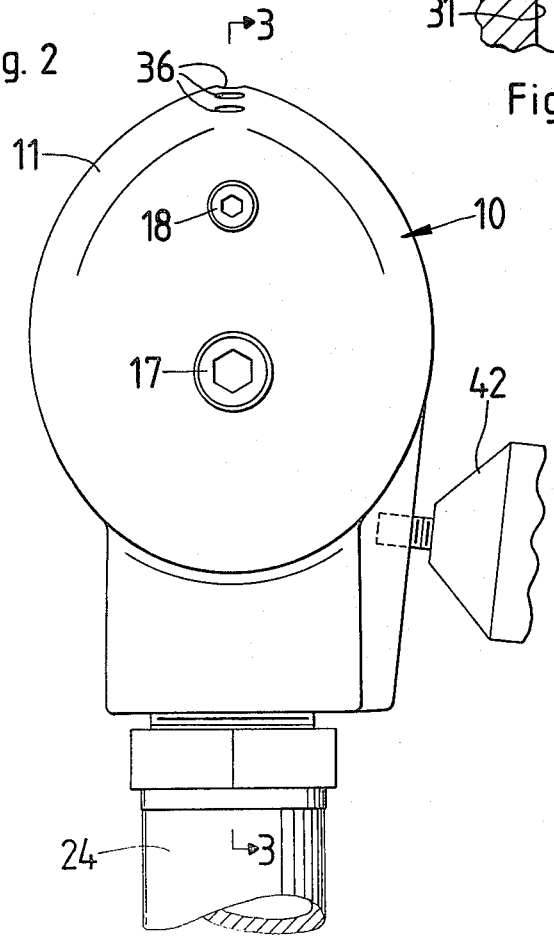
Fig. 7
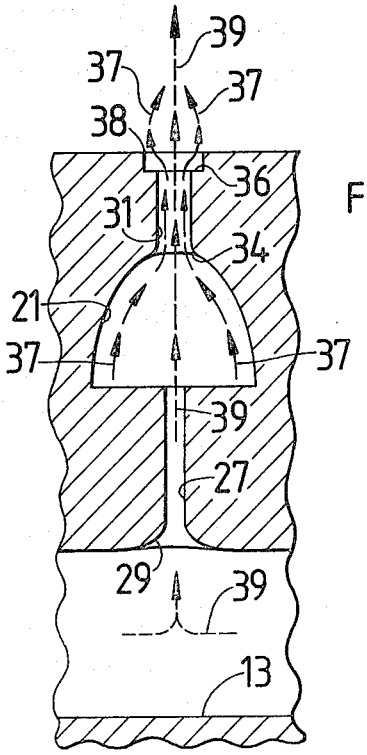

Fig. 6
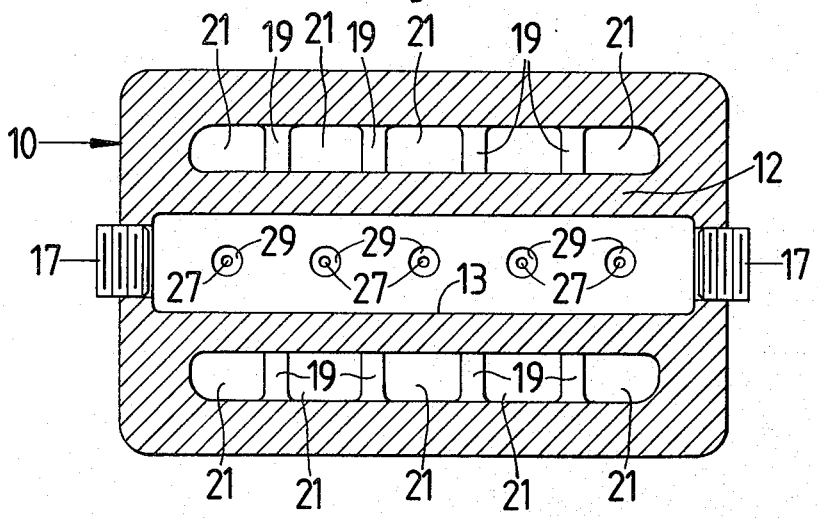
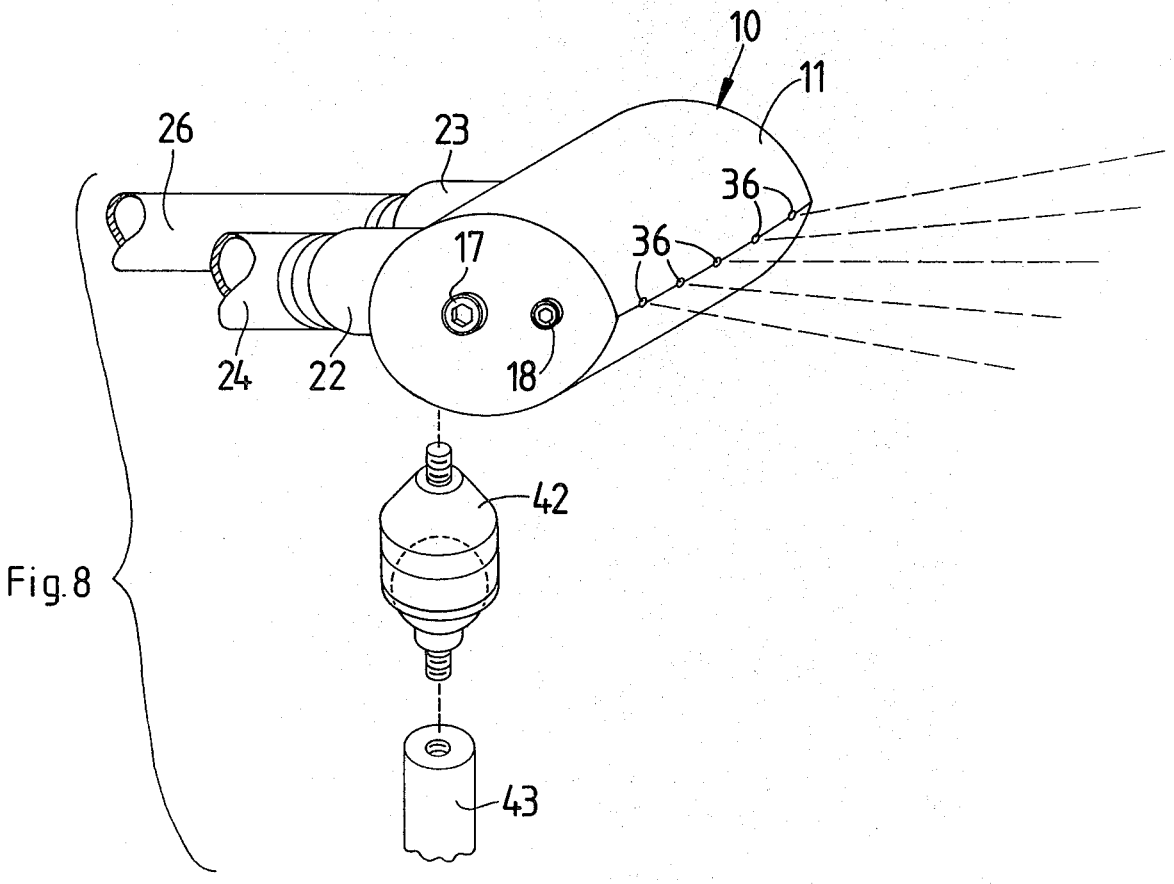
Fig. 8

METHOD AND APPARATUS FOR MAKING SNOW

BACKGROUND OF THE INVENTION

This invention relates to a method and apparatus for making snow and more particularly to an improved method and apparatus which produces increased volumes of snow at marginal snow making temperatures while achieving a less than one-to-one air to water ratio.

As is well known in the art to which my invention relates, many devices or snow guns have been proposed for making artificial snow. Such devices usually mix compressed air and water internally, then spray the same into the ambient air. The cooling effect from the rapid expansion of the compressed air as well as the cooling effect from the sub-freezing ambient air freezes the water to make snow crystals. These internally mixing devices operate on the principal that a column of compressed air passes through the center of each water exit orifice in the snow gun and pulls or draws the water around a column of air whereby the water is atomized. That is, the water and air flowing through the gun passes around sharp corners and over uneven surfaces and other obstructions to mix the air and water before it is discharged into the ambient atmosphere. This mixing action atomizes the water but reduces the momentum of the mixed air and water as it leaves the gun thus reducing the range and trajectory of the snow plume produced.

Depending on the ambient temperature, the air to water ratio achieved by such internally mixing snow guns was always in excess of three parts air to one part water. This ratio was achieved only at ambient temperatures below 0° F. As the temperature approached 32° F., the air to water ratio would significantly increase. Of the two main components employed, air and water, air is the most costly due to the fact that the cost of air compressors is much greater than the cost of water pumps. The cost of operation of air compressors is also much greater than the cost of operating water pumps.

My U.S. Pat. No. 4,194,689, granted Mar. 25, 1980, discloses a snow gun which discharges through its exit nozzles a centrally disposed column of water surrounded by a sheath of compressed air. This snow gun achieved an air to water ratio of approximately two-to-one while producing increased volumes of snow at higher operating temperatures and with less noise. It thus reduced the cost of making snow by reducing the cost of operation of the air compressors which introduced air into the snow gun.

Some inefficiencies and disadvantages still existed with this gun due to the fact that a lower air to water ratio was desired which in turn would reduce still further the cost of introducing compressed air into the snow gun. Other conventional snow guns with which I am familiar are disclosed in the following U.S. Pat. Nos.: 3,761,020; 3,829,013; 3,897,904 and 4,275,833.

SUMMARY OF THE INVENTION

In accordance with my present invention, I provide an improved method and apparatus for making artificial snow which ejects through each of its discharge chambers a centrally disposed column or jet of coherent, laminar flow water that is surrounded by a sheath of compressed, laminar flow air whereby substantially all of the water particles are encased within the sheath of laminar flow air as it moves through the discharge chamber and is then atomized as it is discharged into the ambient atmosphere.

An object of my invention is to provide an improved method and apparatus which achieves a less than one-to-one ratio compressed air to water ratio while converting substantially all of the water discharged from the apparatus into snow crystals.

Another object of my invention is to eliminate uneven surfaces and obstructions in the air and water receiving passageways of the apparatus whereby streamline laminar flowing columns of air and water are formed therein to produce snow plumes having exceptionally long trajectories which disperse the snow uniformly over large areas.

Another object of my invention is to provide a light, easy transportable and adjustable apparatus or snow gun, which has great durability yet is simple to operate, and is not subject to operator error.

Another object of my invention is to provide an improved method and apparatus for making snow wherein all the water particles in each snow plume remain in its expanding column of compressed air as it leaves the apparatus to be exposed to the intense freezing effects of the expanding column of air as well as to the increased time of exposure to the freezing effects of the ambient temperature resulting from the long trajectory of the snow plume.

Still another object of my invention is to provide parallel air and water intakes at the mid portion of my improved apparatus so that unwanted turning moments caused by angle mounted or side mounted intakes are eliminated.

Yet another object of my invention is to increase the efficiency of the snow gun by providing an airfoil-shaped outer housing having a smooth heat reflecting outer surface with the shape of the housing working in combination with the rapidly flowing volumes of air and water ejected from the snow gun to create a venturi effect which draws ambient air from behind the gun thus further increasing the trajectory of the snow plume.

I achieve the above mentioned objects of this invention by providing an improved method and apparatus wherein water under pressure is introduced into a water receiving passageway within a closed inner housing. The inner housing is mounted within a closed outer housing to define an air receiving passageway therebetween. Concomitantly with the introduction of water into the closed inner housing, air under pressure is introduced into the air receiving passageway and is divided into a plurality of laminar flowing columns of air. The water within the water receiving passageway is discharged through a plurality of water discharge orifices with each orifice being of a size and length to discharge a laminar flowing jet stream of water. A plurality of discharge chambers are provided in the outer housing in alignment with the water discharge orifices in the inner housing. Each water discharge orifice directs its laminar flowing jet stream of water through the center of the discharge chamber in alignment therewith as a laminar flowing column of air passes around and encases the jet stream of water.

DESCRIPTION OF THE DRAWINGS

Apparatus for making snow and which may be employed to carry out my improved process is illustrated in the accompanying drawings, forming a part of this application, in which:

FIG. 2 is a side view taken generally along the line 2—2 of FIG. 1;

FIG. 4 is a sectional view taken generally along the line 4—4 of FIG. 3;

FIG. 5 is a sectional view taken generally along the line 5—5 of FIG. 3;

FIG. 6 is a sectional view taken generally along the line 6—6 of FIG. 4;

FIG. 7 is an enlarged, fragmental, sectional view showing a water discharge orifice in alignment with an adjacent discharge chamber;

FIG. 7A is a fragmental, sectional view corresponding to FIG. 7 showing an alternate embodiment of the discharge end of each of the discharge chambers; and FIG. 8 is an exploded perspective view showing my improved apparatus and its swivel joint which is adapted for connection to a supporting structure.

DETAILED DESCRIPTION

Figure 1:
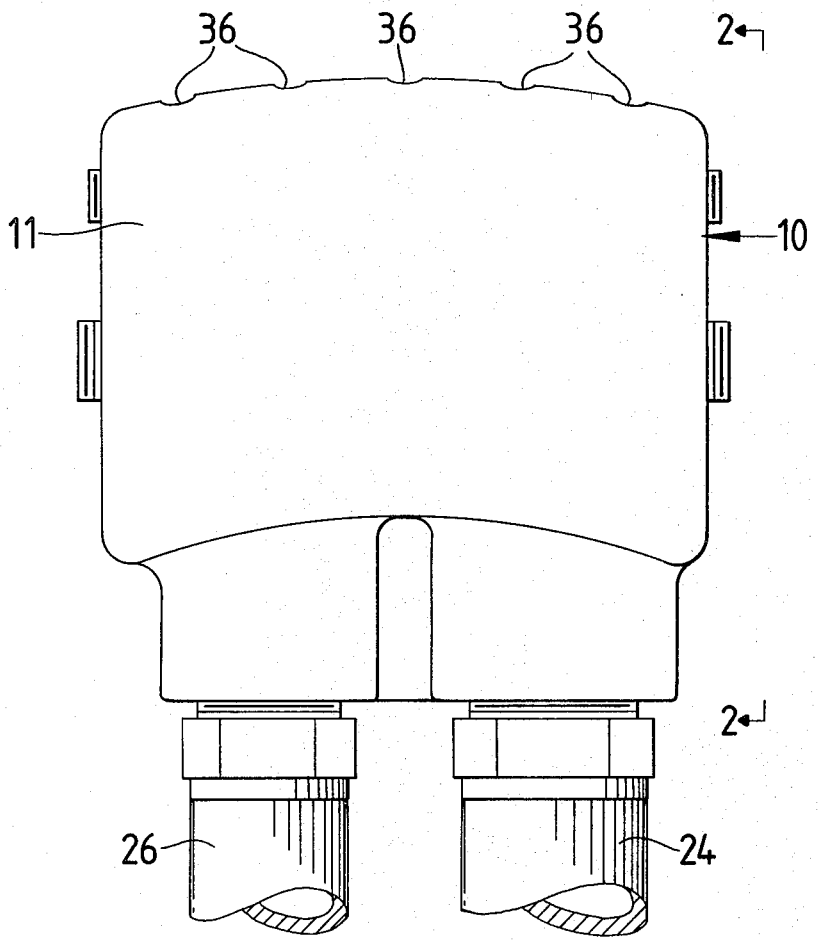
FIG. 1 is a top plan view showing my improved snow making apparatus.
Figure 3:
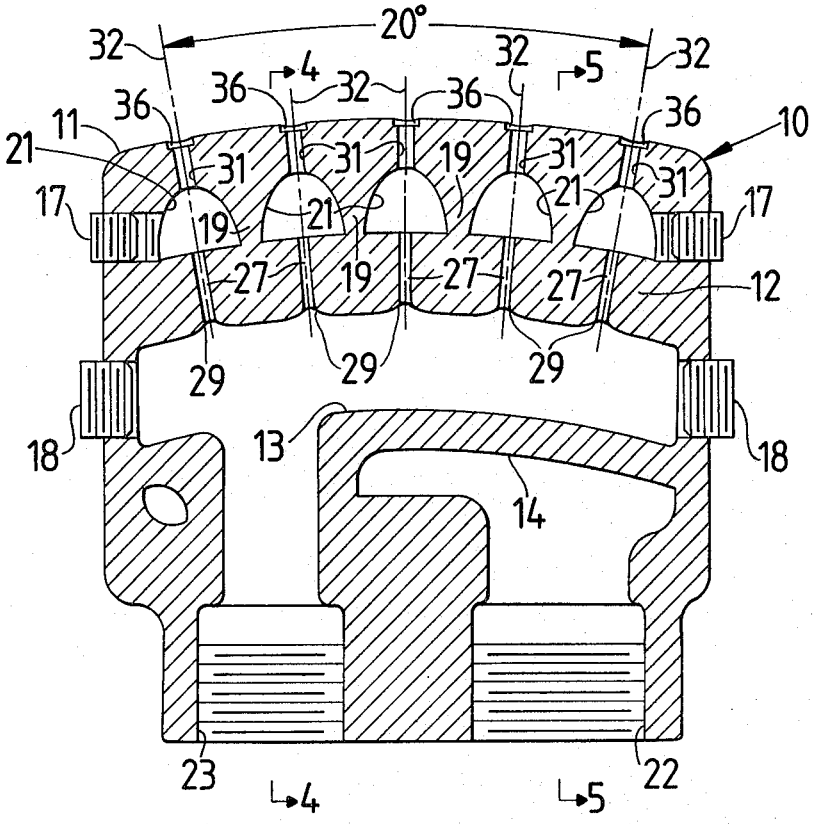
FIG. 3 is a sectional view taken generally along the line 3—3 of FIG. 2.

Referring now to the drawings for a better understanding of my invention, I show in FIGS. 1 and 8 a closed oval-shaped outer housing 10 having a polished, heat reflecting outer surface 11. Formed integrally within the outer housing 10 is a closed oval-shaped inner housing 12 having a water receiving passageway 13 therein, which has a curved inner surface as shown in FIGS. 4 and 5. Preferably, the housings 10 and 12 are formed of thick wall cast aluminum and are concentrically mounted relative to each other to define a uniform oval-shaped air receiving passageway 14 therebetween having surfaces which are uniformly curved, as shown in FIG. 5. The ends of the water receiving passageway 13 and the air receiving passageway 14 are closed by suitable means, such as by threaded plug-like members 17 and 18, respectively, as shown in FIG. 3. The plug-like members 17 and 18 provide access to clean the passageways 13 and 14 in the event foreign matter becomes lodged therein. They also serve as freeze plugs which provide protection of the housings 10 and 12 in the event they should be filled with water and allowed to remain idle in subfreezing conditions.

As shown in FIGS. 3-6, a plurality of spaced apart separator vanes 19 extend transversely between the inner surface of the outer housing 10 and the outer surface of the inner housing 12 to divide a portion of the air receiving passageway 14 into a plurality of uniformly curved air flow chambers 21.

Projecting outwardly from the mid portion of one side of the outer housing 10 are air and water receiving inlets 22 and 23, respectively, as shown. Air under pressure is supplied to the air inlet 22 through a conduit 24 which is operatively connected to a suitable source, such as a compressor, not shown. The conduit 24 supplies air to the passageway 14 between the outer and inner housings 10 and 12 as shown in FIGS. 3 and 5. A water supply conduit 26 communicates with the water inlet 23 to supply water under pressure from a suitable source, not shown, to the water receiving passageway 13 within the inner housing 12, as shown.

A plurality of angularly spaced, elongated water discharge orifices 27 are provided through the side of the inner housing 12 opposite the side thereof which is adjacent the water inlet 23, as shown in FIG. 3. The size and length of each water discharge orifice 27 is such that it substantially alleviates all turbulent actions in the water stream flowing therethrough. That is, as water under pressure enters the inlet end of each orifice 27, a turbulent velocity profile is produced in the direction of flow. This profile shrinks as the turbulent effects in water stream subside. Finally, a fully developed uniform laminar velocity profile is established within the orifice with only a minimum loss of fluid momentum being experienced. To further reduce fluid momentum losses, a smooth curved depression or dimple 29 is provided in the inlet end of each water discharge orifice 27. Each dimple 29 serves as a transition zone which aids in the development of a laminar boundary layer in the fluid at the inlet end of the orifice 27. As the boundary layer moves down stream it develops into a uniform laminar jet stream of water which is ejected into an adjacent air flow chamber 21. In "Mechanics of Fluids" by Shames, the required length of each water discharge orifice to obtain laminar flow for a given diameter may be determined by the following well known expression:

$$Zt=0.03\ R_{ey}D$$

where

Zt = length of transition from turbulent entrance conditions to a fully developed laminar flow;

$R_{ey}$ = Reynolds number of the water flowing through the water discharge orifice; and D = diameter of the water discharge orifice.

In actual practice, I have found that a water discharge orifice 27 having a diameter of approximately 0.1775 inches and being approximately 1.0 inches in length produces a satisfactory jet stream of laminar flowing water.

As shown in FIGS. 3 and 8, elongated spaced apart discharge chambers 31 of a diameter larger than the water orifices 27 are provided through a curved side of the outer housing 10 nearest the water orifices 27. Each discharge chamber 31 is aligned axially with the adjacent water discharge orifice 27 whereby they extend axially along radial lines 32 which are angularly disposed relative to each other so that individual snow plumes ejected from my improved snow gun do not interfere with each other until snow formation occurs. Each water discharge orifice 27 is thus adapted to direct its laminar flowing jet stream of water through the center of the adjacent, aligned discharge chamber 31. In actual practice, I have found that a snow gun having five equally spaced discharge chambers 31 with an angular distance of approximately 20° between the outermost radial lines 32 operates satisfactorily in every respect.

As compressed air from the air supply conduit 24 enters the air receiving passageway 14, it flows toward the separator vanes 19 where it is separated into individual laminar flowing columns of air, as indicated by the arrows 33 in FIG. 5. The columns of air flowing in each curved air flow chamber 21 flow toward the inlet end of the adjacent discharge chamber 31 and then move uniformly around and surround the laminar flowing jet stream of water flowing through the curved air flow chamber 21 as it enters the inlet end of the adjacent discharge chamber 31. That is, the size and length of the discharge chambers 31 cause the air to uniformly encase the jet streams of water flowing therethrough in a sheath of compressed air. The length of the discharge chambers 31 also maintains the air and water in laminar flow whereby the trajectory of the snow plume ejected from the snow gun is significantly increased. In actual practice, I have found that a discharge chamber 31 spaced approximately 0.875 inches from its associated water discharge orifice 27 and having a diameter of approximately 0.3125 inches and a length of approximately 0.50 inches will maintain the jet stream of water and the column of air flowing therethrough in laminar flow. For a given diameter of discharge chamber 31, the length required to maintain laminar flow therein may be determined from the expression in Shames' "Mechanics of Fluids" described above.

A smooth, curved depression or dimple 34 is provided in the inlet end of each discharge chamber 31 to facilitate the smooth flow of air whereby the air surrounds and encases the jet stream of water passing therethrough. Each dimple 34 also provides an efficient way to smoothly combine spurious water in the adjacent air flow chamber 21 with the water jet flowing therethrough. Furthermore, each dimple 34 provides a smooth transition zone for the columns of air to pass uniformly around and surround the jet stream of water flowing therethrough with a minimum loss of momentum.

As shown in FIGS. 3–7, the outlet end of each discharge chamber 31 is enlarged to provide an annular recess 36 which has a diameter larger than the diameter of the discharge chamber 31. The recess 36 permits rapid expansion of the sheath of compressed air around the centrally disposed stream of water, as indicated by the solid line arrows 37 in FIG. 7. The expanding air strikes the upper lip 38 of the recess 36 and is deflected back toward the jet stream of water, indicated by the dot-dash arrows 39. This creates a shock wave through the jet stream of water which atomizes the water entirely within the expanding column of air. Since the atomized water particles are totally contained within the expanded column of air, they are exposed to three beneficial freezing factors. First, the water particles are exposed to the intense refrigeration and freezing effects of the expanding compressed air. Second, they are exposed to the freezing effects of the ambient temperatures existing during snow making. Third, since the atomized water particles are combined with a laminar flowing column of air, each atomized particle is ejected along a significantly increased trajectory as compared with particles not encased in such compressed air sheaths. This longer trajectory provides a longer time for each atomized water particle to be exposed to the ambient air freezing conditions. This also allows the snow maker to apply more water to the gun at any given temperature to create greater volumes of snow of better quality with a minimum amount of air being used.

After many hours of operation, the diameter of the recess 36 may become enlarged thereby decreasing the efficiency of the snow gun. This is especially true when water having sand and other impurities is used. To correct this problem, a ceramic or brass insert 41 may be placed in each of the recesses 36 to restore the gun to its original efficiency, as shown in FIG. 7A.

As shown in FIG. 8, my improved apparatus may be supported by a supporting structure having a swivel joint 42 which is adapted for connection to a supporting member 43. The swivel joint 42 permits the snow gun to be rotated 360° and also provides a 45° elevation adjustment.

From the foregoing description, the operation of my improved method and apparatus for making snow will be readily understood. Compressed air and water under pressure are concomitantly introduced through the inlets 22 and 23, respectively, into the air receiving passageway 14 and the water receiving passageway 13. Laminar flowing jet streams of water are then discharged from the water receiving passageway 13 through the water discharge orifice 27 with each orifice 27 directing its jet stream of water toward the axial center of the adjacent discharge chamber 31. That is, each water discharge orifice 27 is of a size and length to substantially alleviate all of the turbulence in the jet stream of water flowing therethrough with a fully developed laminar flowing jet stream of water being ejected from its exit end thereof.

After the compressed air enters the air receiving passageway 14, it flows toward the separator vanes 19 where it is divided into a plurality of laminar flowing columns of air. As each jet stream of water moves toward the adjacent discharge chamber 31, a column of laminar flowing compressed air begins to move uniformly around and surrounds the jet stream of water. The two components then enter the discharge chamber 31 with the size and length of the chamber causing the compressed air to uniformly encase the jet stream of water in a sheath of compressed air. As each encased jet stream of water flows outwardly from its discharge chamber 31, the sheath of compressed air expands very rapidly and strikes the upper lip 38 of the annular recess 36 provided in the exit end of the discharge chamber. Upon striking the upper lip 38, the air is then directed back toward the jet stream of water where it totally atomizes the water. Since the housings 10 and 12 are designed to maintain the momentum of water and air flowing therethrough, the trajectory of the atomized water particles contained within the expanding columns of air is significantly increased.

From the foregoing, it will be seen that I have devised an improved method and apparatus for converting large quantities of water into snow wherein a minimum air to water ratio is required. Also, by reducing the air to water ratio, my improved apparatus reduces the cost of making snow and is much quieter in its operation. Furthermore, by constructing my apparatus from smooth light-weight housings which eliminate sharp corners and other obstructions that reduce the momentum of the air and water flowing therethrough, I provide apparatus which not only is quiet in its operation but also dispenses increased volumes of snow over large areas due to its extended trajectory or throw.

While I have shown my invention in but one form, it will be obvious to those skilled in the art that it is not so limited, but is susceptible of various other changes and modifications without departing from the spirit thereof.

What I claim is:

1. In apparatus for making snow comprising:

(a) a closed inner housing having a water receiving passageway therein and a uniformly curved outer surface, (b) a closed outer housing incasing said inner housing and having a uniformly curved inner surface spaced from said outer surface of said inner housing and defining a uniformly curved air receiving passageway therebetween, (c) air supply means supplying air under pressure to said air receiving passageway, (d) water supply means supplying water under pressure to said water receiving passageway, (e) a plurality of spaced apart separator vanes extending in the direction of air flow between said uniformly curved inner surface of said outer housing and said uniformly curved outer surface of said inner housing and defining uniformly curved air flow chambers therebetween which divide the air flowing through said air receiving passageway into a plurality of laminar flowing columns of air, (f) a plurality of spaced apart elongated water discharge orifices through a side of said inner housing with each said elongated water discharge orifice being of a size and length to eject a laminar flowing jet stream of water into an adjacent uniformly curved air flow chamber, (g) a plurality of spaced apart, elongated discharge chambers extending through the side of said outer housing nearest said water discharge orifices in said inner housing with each said elongated water discharge orifice being in axial alignment with an adjacent elongated discharge chamber extending through said outer housing and directing its laminar flowing jet stream of water through the center of said adjacent elongated discharge chamber with each of said laminar flowing columns of air passing uniformly around and surrounding its jet stream of water as it moves through said air flow chamber and then through said elongated discharge chamber, and (h) said elongated discharge chamber in said outer housing being of a size and length to maintain said jet stream of water and its column of air passing therethrough in laminar flow.

2. A method for making snow comprising the steps of, (a) introducing water under pressure into a closed inner housing having a uniformly curved water receiving passageway therein with said inner housing mounted within a closed outer housing having a uniformly curved air receiving passageway therebetween, (b) introducing air into said air receiving passageway while concomitantly introducing said water under pressure into said water receiving passageway, (c) dividing said air flowing within said air receiving passageway in the direction of flow through said air receiving passageway into a plurality of laminar flowing columns thereof, (d) discharging water from said water receiving passageway through a plurality of spaced apart elongated water discharge orifices through a side of said inner housing with each said orifice being of a size and length to discharge a laminar flowing jet stream of water through the axial center of an adjacent elongated discharge chamber in said outer housing, and (e) passing each said laminar flowing column of air uniformly around and surrounding its laminar flowing jet stream of water as said jet stream of water passes through its laminar flowing column of air and then passes through said adjacent elongated discharge chamber.

3. Apparatus for making snow as defined in claim 1 in which said spaced apart, axially aligned elongated water discharge orifices and elongated discharge chambers extend along lines which are angularly disposed relative to each other so that adjacent streams of atomized water discharged from adjacent elongated discharge chambers move generally radially and outwardly from said outer housing without interfering with each other.

4. Apparatus for making snow as defined in claim 1 in which the diameter and length of each said elongated water discharge orifice is approximately 0.1775 inches and 1.0 inches, respectively.

5. Apparatus for making snow as defined in claim 1 in which the diameter and length of each said elongated discharge chamber is approximately 0.3125 inches and 0.500 inches, respectively.

6. Apparatus for making snow as defined in claim 1 in which the distance between said elongated water discharge orifices in said inner housing and said elongated discharge chambers in said outer housing is approximately 0.8750 inches.

7. Apparatus for making snow as defined in claim 1 i $Zt$ = length of transition from turbulent entrance conditions to a fully developed laminar flow;

$R_{ey}$ = Reynolds number of the water flowing through the water discharge orifice; and $D$ = diameter of the water discharge orifice.

* * * * *

UNITED STATES PATENT AND TRADEMARK OFFICE

CERTIFICATE OF CORRECTION

PATENT NO. : 4,465,230

DATED : August 14, 1984

INVENTOR(S) : Robert M. Ash

It is certified that error appears in the above—identified patent and that said Letters Patent is hereby corrected as shown below:

In Claim 7, line 1 after "Claim 1", delete "i" and insert - in which the length of each said elongated water discharge orifice of a given diameter and the length of each said elongated discharge chamber of a given diameter is defined by the equation:

$$Zt = 0.03\ ReyD \text{ where -}$$

Signed and Sealed this

Fourteenth Day of October, 1986

[SEAL]

*Attest:*

DONALD J. QUIGG

*Attesting Officer*

*Commissioner of Patents and Trademarks*